US005989163A

United States Patent [19]

Rodgers, Jr.

[11] Patent Number: 5,989,163

[45] Date of Patent: Nov. 23, 1999

[54] LOW INERTIA EXERCISE APPARATUS

[76] Inventor: Robert E. Rodgers, Jr., 8011 Meadowcroft, Houston, Tex. 77063

[21] Appl. No.: 09/090,194

[22] Filed: Jun. 4, 1998

[51] Int. Cl.[6] ..... A63B 22/00; A63B 21/22

[52] U.S. Cl. ..... 482/70; 482/110; 482/71; 482/95; 482/96; 482/52

[58] Field of Search ..... 482/110, 70, 51, 482/52, 53, 54, 95, 96

[56] References Cited

U.S. PATENT DOCUMENTS

| | | | |
|---|---|---|---|
| 4,679,786 | 7/1987 | Rodgers . | |
| 5,192,257 | 3/1993 | Panasewicz | 482/70 |
| 5,230,677 | 7/1993 | Chi | 482/70 |
| 5,328,427 | 7/1994 | Sleamaker | 482/71 |
| 5,336,143 | 8/1994 | Wu | 482/52 |
| 5,792,026 | 8/1998 | Maresh | 482/51 |
| 5,792,029 | 8/1998 | Gordon | 482/52 |
| 5,803,871 | 9/1998 | Stearns | 482/52 |
| 5,836,854 | 11/1998 | Kuo | 482/52 |
| 5,848,954 | 12/1998 | Stearns | 482/52 |
| 5,879,271 | 3/1999 | Stearns | 482/51 |
| 5,882,281 | 3/1999 | Stearns | 482/51 |

*Primary Examiner*—Richard J. Apley
*Assistant Examiner*—William LaMarca
*Attorney, Agent, or Firm*—Fulbright & Jaworski L.L.P.

[57] ABSTRACT

This is a stationary exercise apparatus capable of more accurately representing body motion associated with walking and running. The apparatus includes an inertia system which enables the apparatus to accelerate each reciprocating pedal up to a predetermined velocity. In this manner, the exercise workout is more natural since the user only has to expend energy normally associated with walking or running and not the operation of the apparatus.

17 Claims, 7 Drawing Sheets

FIG. 6
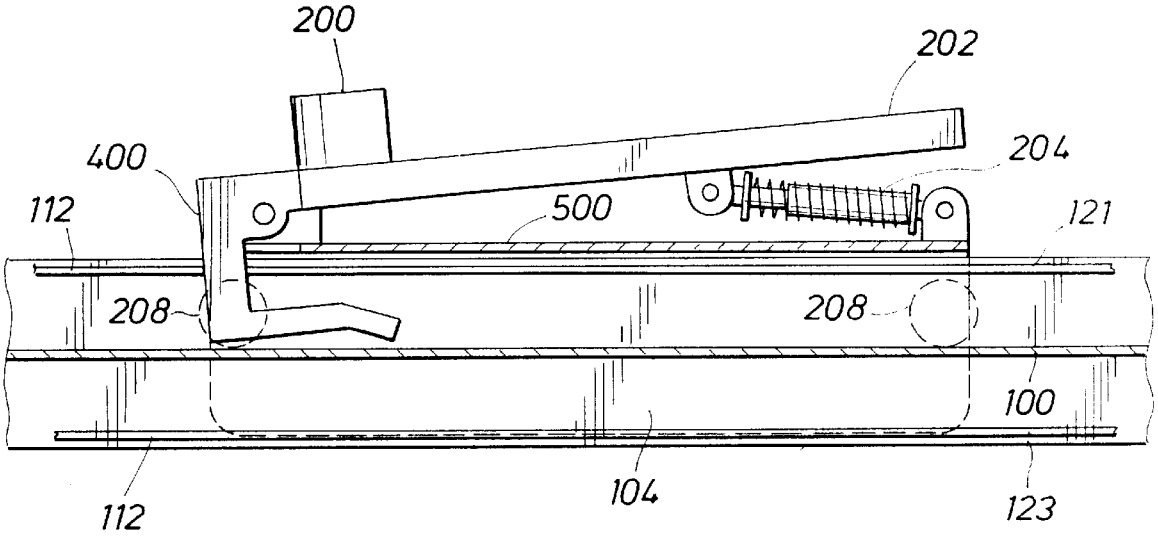
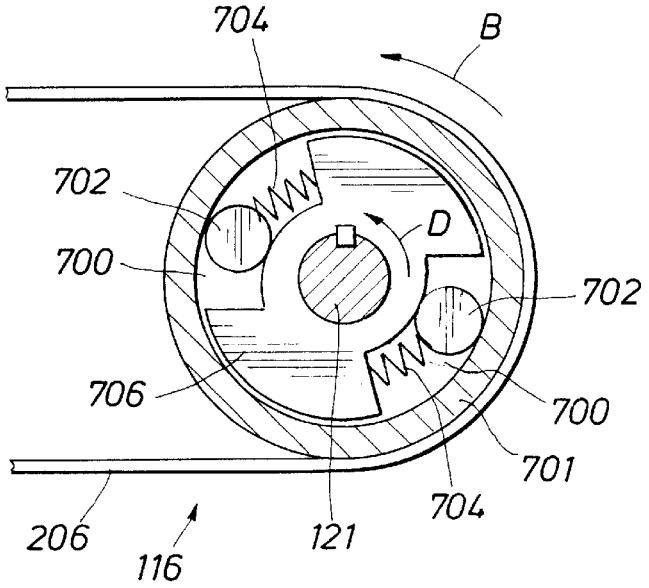
FIG. 7
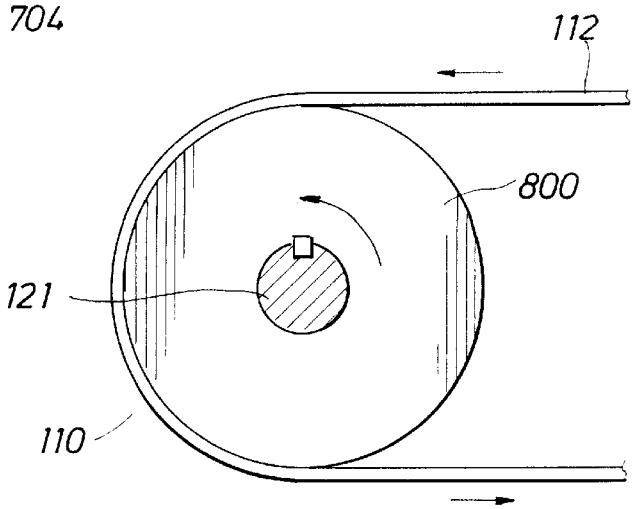
FIG. 8

LOW INERTIA EXERCISE APPARATUS

CROSS-REFERENCE TO RELATED APPLICATIONS

Not Applicable

STATEMENT REGARDING FEDERALLY SPONSORED RESEARCH

Not Applicable

BACKGROUND OF THE INVENTION

1. Field of the Invention

The present invention relates to a stationary low inertia exercise apparatus. More particularly, the present invention relates to a low inertia exercise apparatus which enables the user to move his feet in a reciprocating path more accurately representing body motion associated with walking or running, but without the need to accelerate the pedals of the apparatus up to system speed.

2. Description of the Related Art

Walking, running, and skiing are popular forms of exercise. Through exercise, the user attempts to load the cardiovascular system and/or attempts to build muscle mass. The exercises of walking, running, and skiing accomplish these goals with a minimal amount of equipment. However, due to environmental situations such as inclement weather, walking, running, or skiing outdoors may be difficult to accomplish. To help alleviate this problem, the prior art discloses apparatus which enable the user to exercise within an enclosed structure while obtaining most of the benefits of walking, running, or skiing. Several machines attempt to emulate the exercises of skiing and walking or running, for example, U.S. Pat. Nos. 3,941,377; 4,684,121; and 4,960,276. U.S. Pat. No. 3,941,377 discloses an apparatus which includes a variable resistance when the foot carriages are moved rearwardly and allows free movement of the foot carriage in the forwardly direction. In U.S. Pat. No. 4,684,121, the apparatus can also be used to simulate skiing motions or can be used to simulate a rowing motion. Adapted for a skiing exercise, the foot carriages can be moved along rails against a variable resistance. The resistance is constant regardless of the direction of the movement of the foot carriages. In U.S. Pat. No. 4,960,276, another skiing simulation apparatus is disclosed.

These three machines fail to completely emulate the exercises of skiing and walking or running in that each requires the user to exert force to operate the system. In other words, the user must exert additional force to accelerate each pedal or foot block back to system speed. This added force creates unnatural feelings and stress on the user. Therefore, the need exists for an improved exercising apparatus which allows the user to emulate the exercises of skiing, walking, or running without requiring the user to exert additional force to operate the system.

SUMMARY OF THE INVENTION

The present invention provides a stationary exercise apparatus having a frame, and two rails supported by a portion of the frame. A traveler is movably attached to each rail and moves in a reciprocating manner. An inertia drive assembly is located approximate one end of the rails and provides for the acceleration of both travelers up to a predetermined velocity which is established by the user's exercise rate. In this manner, the user does not have to exert the additional force required to accelerate each traveler to the user's exercise rate following the rearward movement of each leg. The inertia drive system will accelerate the rearward pedal forward and the forward pedal rearward up to the exercise rate of the user enabling the user to enjoy a more natural jog or running gate.

The present invention also provides a stationary exercise apparatus including a frame, and two rails supported by at least a portion of the frame. The first rail is generally parallel with the second rail. A traveler is movably attached to each rail via wheels; the travelers are adapted to allow for the user to place his feet in a normal walking position. An inertia drive assembly is located at the front portion of the exercise apparatus. Below each rail, a belt spans substantially the entire length of the stroke of the user and is connected to an inertia drive shaft at the front end of the exercise apparatus and a pulley at the rear end of the exercise apparatus. Movement of the belts rotates the inertia drive shaft which in turn rotates the inertia weight. A coupling assembly is attached to the travelers for selectively engaging each traveler to a corresponding belt. When operating the exercise apparatus the user imparts force to the inertia drive assembly thereby permitting the system to accelerate each traveler up to a predetermined system speed.

BRIEF DESCRIPTION OF THE DRAWINGS

A better understanding of the present invention can be obtained when the following detailed description of the preferred embodiment is considered in conjunction with the following drawings, in which:

FIG. 6 is a cross-sectional view of the present invention taken along line 6—6 of FIG. 4;

FIG. 7 is a cross-sectional view of a clutch pulley as shown in FIG. 1;

FIG. 8 is a detailed view of a conventional pulley as shown in FIG. 1.

DETAILED DESCRIPTION OF THE PREFERRED EMBODIMENT

Figure 1:
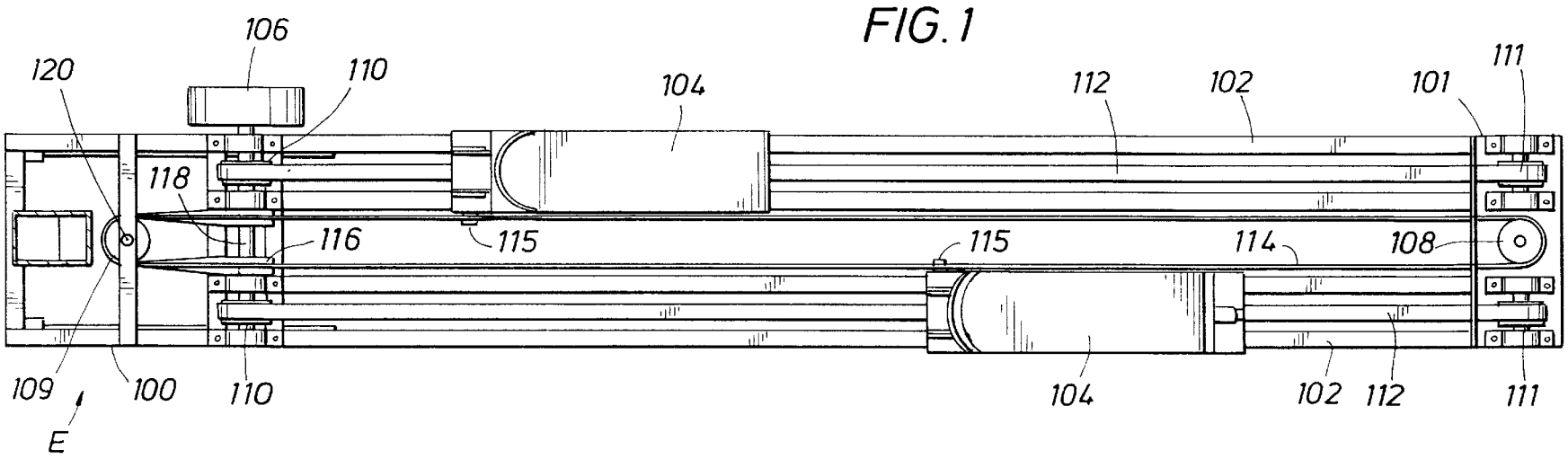
FIG. 1 is a plan view of the present invention.
Figure 2:
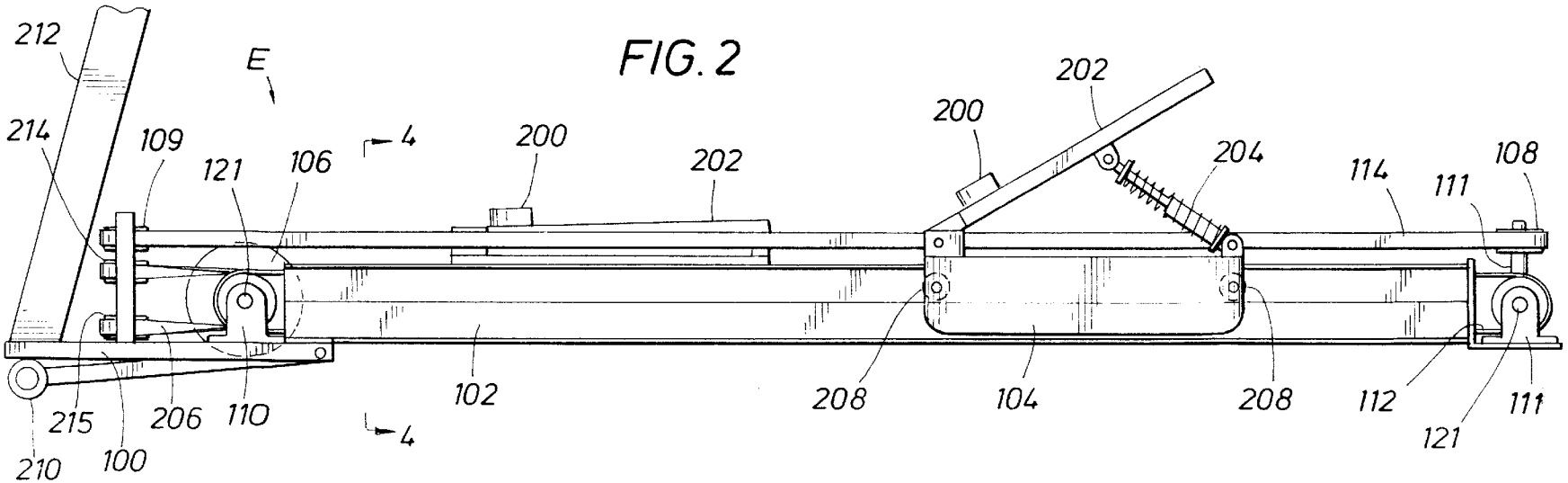
FIG. 2 is an elevation view of the present invention.

Referring to FIGS. 1 and 2, the stationary exercise apparatus E includes a front frame 100 and a rear frame 101. Front frame 100 and rear frame 101 are connected by rails 102 and are supported by the floor. An elevation adjustment arm 210 is pivotally attached to front frame 100 and a stand 212 is also connected to front frame 100. Stand 212 may include handles or armrests, or may include any panels or gauges which may represent time spent or exercise amount completed. Elevation adjustment arm 210 is located toward the front end of stationary exercise apparatus E and is maneuverable such that the front end of stationary exercise apparatus E is upwardly adjustable. This allows stationary exercise apparatus E to be placed in an inclined position with the front end elevated an amount greater than the rear end.

Figure 4:
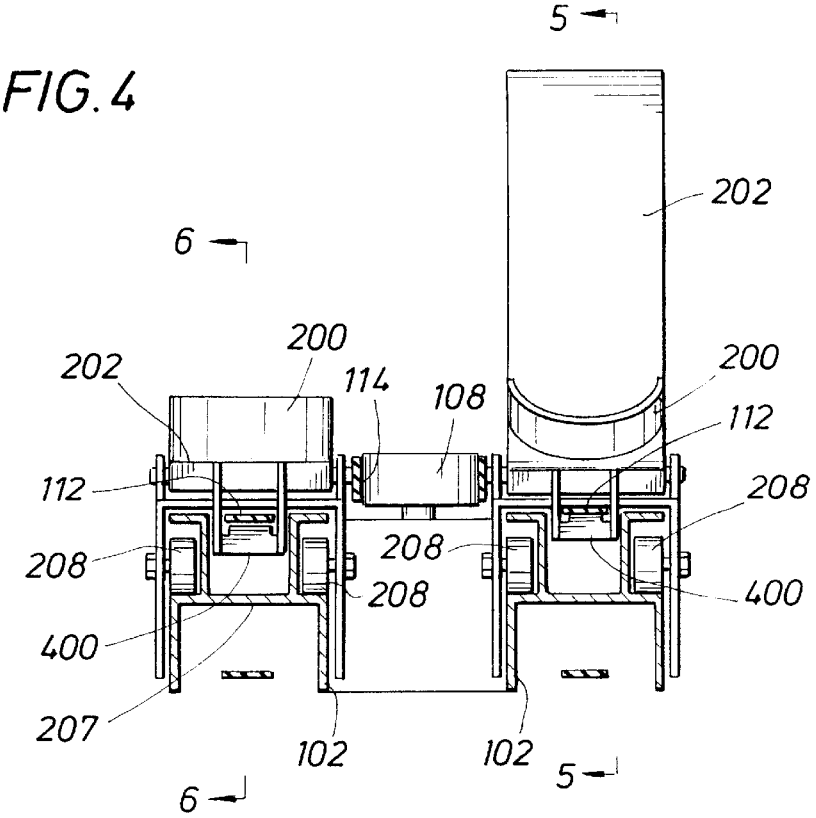
FIG. 4 is a cross-sectional view of the present invention taken along line 4—4 of FIG. 2.

Rails 102 are parallel to each other. The rails 102 are placed a distance apart at the approximate width of a human's stance. Travelers 104 are movably attached to rails 102 and include foot attachment carriages and wheels. Each foot attachment carriage includes a foot base portion 202, a compression spring 204 and a foot toe piece 200. Travelers 104 are connected such that they can move longitudinally along rails 102 via wheels 208 and each traveler 104 moves reciprocally from the other traveler 104. Wheels 208 are located at the front and rear end of each traveler 104 and are slidably engaged along flange 207 of rails 102 as shown in FIG. 4.

Each foot attachment carriage is pivotally connected to a traveler 104 at the front and top edge of traveler 104. As pressure is released off the foot base portion 202, the compression spring 204 expands forcing the rear end of base portion 202 to elevate relative to the front edge of the foot base portion.

Figure 3:
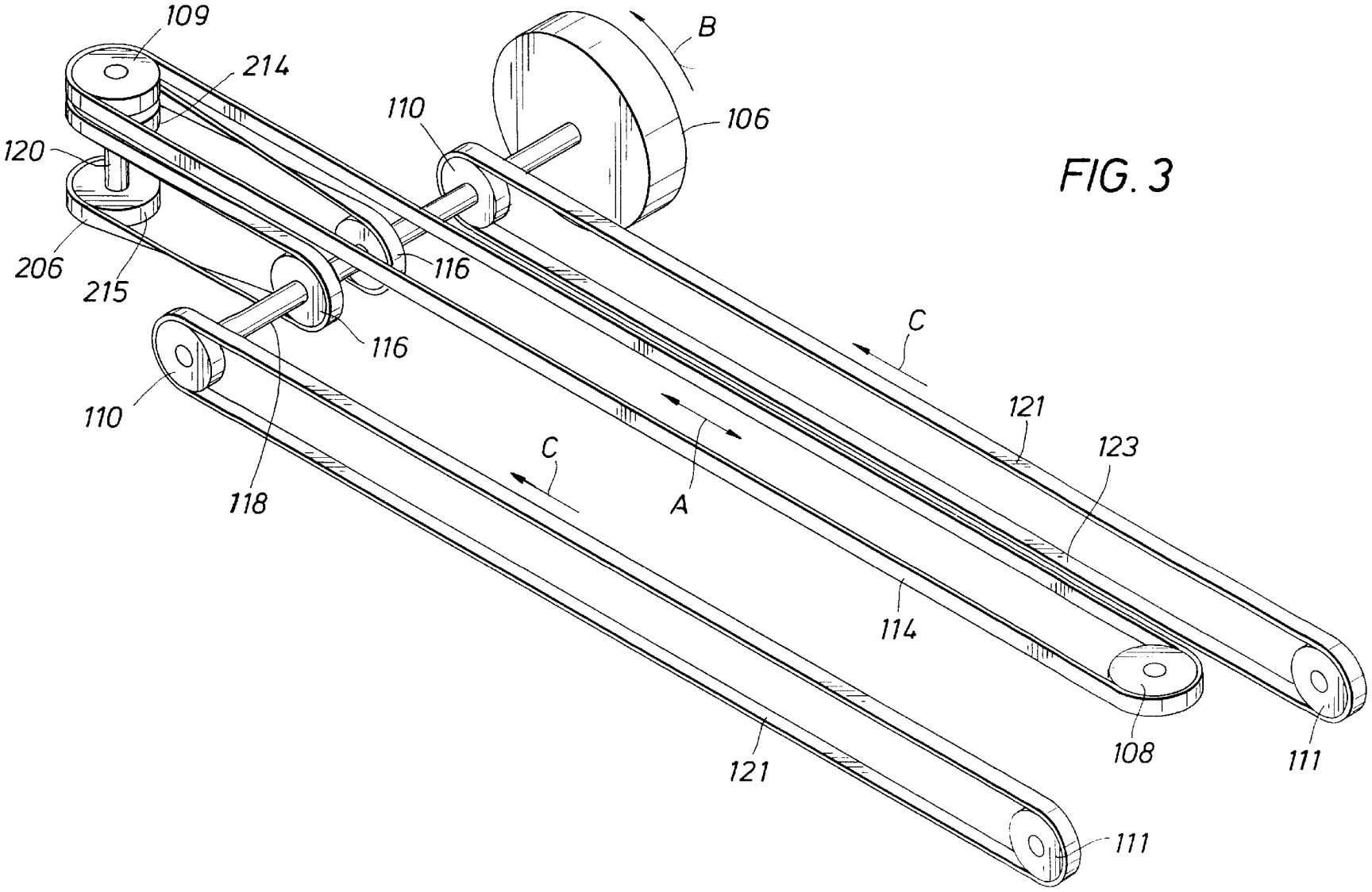
FIG. 3 is a perspective view of a portion of the present invention.

Referring now to FIG. 3 in addition to FIGS. 1 and 2, each traveler 104 is fixedly attached to a belt 114 by a clamp 115, for example, and is movably attached above an inertia belt 112. Belt 114 spans longitudinally the length of rails 102 and is supported to the front frame 100 and rear frame 101 through pulleys 108 and 109. Pulley 108 is an idler pulley while pulley 109 is a driver pulley used to drive the inertia system as described below. An inertia belt 112 runs longitudinally with, and is substantially contained within, each rail 102. Each inertia belt 112 is supported at front frame 100 by drive pulley 110 and rear frame 101 by idler pulley 111.

Referring still to FIG. 3, the inertia transfer portion of stationary exercise apparatus E includes front drive pulleys 110, inertia shaft 118, front flywheel/brake 106, clutch pulleys 116, clutch belt 206, pulleys 214 and 215, and vertical shaft 120. Pulleys 110 are attached to inertia shaft 118 which is rigidly attached to flywheel/brake 106. As discussed below, clutch pulleys 116 engage inertia shaft 118 only when moving in a counterclockwise rotation. Clutch belt 206 engages clutch pulleys 116 and pulleys 214 and 215. While pulley 214 is fixed to shaft 120, pulley 215 idles relative to shaft 120. Flywheel 106 may include a brake system to increase or decrease resistance, well known to those skilled in the art. Such a brake may include a mechanical band brake system or an electromagnetic brake system, or an air-fan brake system.

As belt 114 is moved in a reciprocal manner as shown by arrow A, pulley 108 idles whereas front pulley 109 rotates shaft 120 in a reciprocal manner. As shaft 120 moves in a reciprocal manner, pulley 214 rotates clutch belt 206 in a reciprocal manner. However, due to clutch pulleys 116, inertia shaft 118 rotates only in a counterclockwise rotation as described below. Thus, inertia shaft 118 and flywheel/brake 106 only rotate in a counterclockwise rotation as shown by arrow B. This motion forces each inertia belt 112 to rotate around pulleys 110 in the direction of arrow C.

Each traveler 104 is clamped at 115 to a belt 114 (as seen in FIG. 1). Thus, as each traveler 104 is forced from the front portion of stationary exercise apparatus E to the rear portion, belt 114 is similarly moved in that direction. The movement of each traveler 104 toward the rear end of stationary exercise apparatus E transfers energy to flywheel 106 through pulleys 108, 214, and clutch pulleys 116 as shown above.

Clutch pulleys 116 are configured such that one pulley 116 is spinning in a clockwise rotation while the other pulley 116 is spinning in a counterclockwise rotation. Clutch pulleys 116 are standard overrunning clutch systems, well known to those skilled in the art. This ensures that the bi-directional movement of belt 206 is applying a force to inertia shaft 118 at all times regardless of which direction belt 114 is moving.

Referring now to FIG. 7, one type of overrunning clutch system is disclosed. Each clutch pulley 116 includes an outer housing 701, an inner portion 706, balls 702, and springs 704, thereby defining two angular slots 700. Clutch pulley 116 uses a ball and spring clutch mechanism to allow the clutch pulley to rotate in a bi-directional manner while only engaging inertia shaft 118 in a unidirectional manner. Flywheel 106/Shaft 121 always rotate in a counterclockwise direction as shown by arrow D. When Belt 206 rotates housing 701 counterclockwise in the direction of arrow B, angular slots 700 narrow engaging balls 702, thereby locking inner portion 706 relative to housing 701 and introducing additional counterclockwise movement to shaft 118 and flywheel 106 to keep it moving in the direction of arrow D. More specifically, as slots 700 move, each ball 702 is wedged in the slot 700 and housing 701 is locked within inner portion 706. Similarly, when clutch belt 206 rotates in a clockwise direction, housing 701 moves in a clockwise direction. Spring 704 is in compression and serves to bias ball 702 toward the narrow end of slot 700. Thus, as clutch pulley 116 rotates in a clockwise manner, inner portion 706 is not engaged within housing 701, and inner portion 706 and shaft 118 continue to rotate in a counterclockwise direction, while housing 701 and the clutch belt 112 rotate in a clockwise direction.

Drive pulley 110 is shown in FIG. 8. Pulley 110 includes an inner portion 800 on shaft 121. As inertia belt 112 travels in either direction, inner portion 800 rotates in that same direction.

Figure 5:
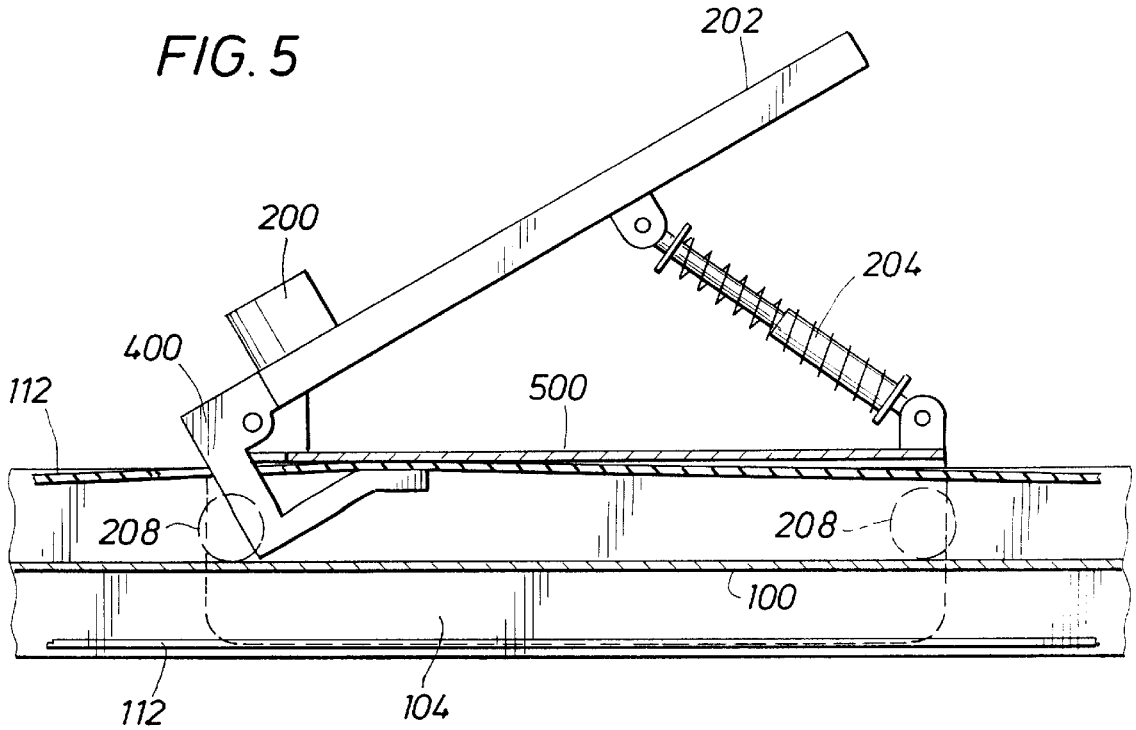
FIG. 5 is a cross-sectional view of the present invention taken along line 5—5 of FIG. 4.

Referring now to FIGS. 4, 5, and 6, each traveler 104 includes wheels 208 which enable each traveler to move along rails 102. As shown, wheels 208 ride along flange 207 of each rail 102. Inertia belt 112 as positioned comprises an upper segment or portion 121 and a lower segment or portion 123.

When the foot attachment carriage is in a substantially horizontal position, as shown in FIG. 6, coupling member 400, which is attached to the bottom edge of the foot base portion 202, permits free movement of inertia belt 112 relative to the traveler 104. When foot base portion 202 is forced into a generally horizontal position, spring 204 is compressed and lip 131 of member 400 moves downward disengaging traveler 104 from upper segment 121 of inertia belt 112. Thus, traveler 104 is free to move independently of inertia belt 112 from the front to rear of the exercise apparatus, which is the rearward power stroke of the leg of the user.

In summary, when foot base portion 202 is forced into a substantially horizontal attitude, which occurs when the user is exerting force, traveler 104 is in the active position, disengaged from belt 112 and is moved from the front end of stationary exercise apparatus E to the rear end of the stationary apparatus. When the user removes weight from the foot base portion 202, spring 204 forces the rear end of foot base portion 202 to be elevated. When the foot attachment carriage is in the inclined or inactive position, the coupling member 400 forcibly attaches to inertia belt 112 and the traveler 104 is then moved along the same rotational path as inertia belt 112 back to the front of the apparatus in preparation for the power stroke.

Figure 13:
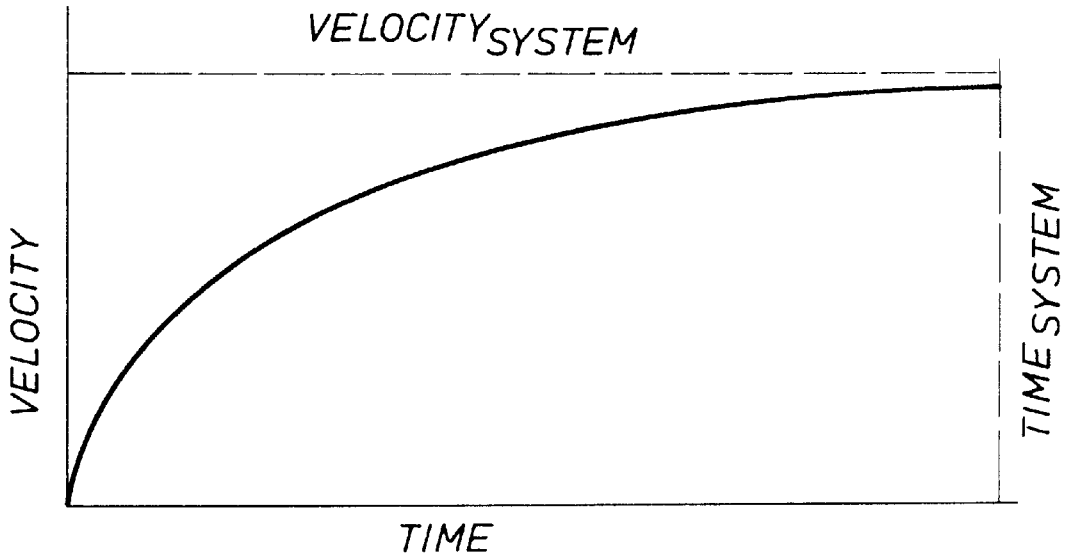
FIG. 13 is a graph of velocity versus time of the present invention.
Figure 14:
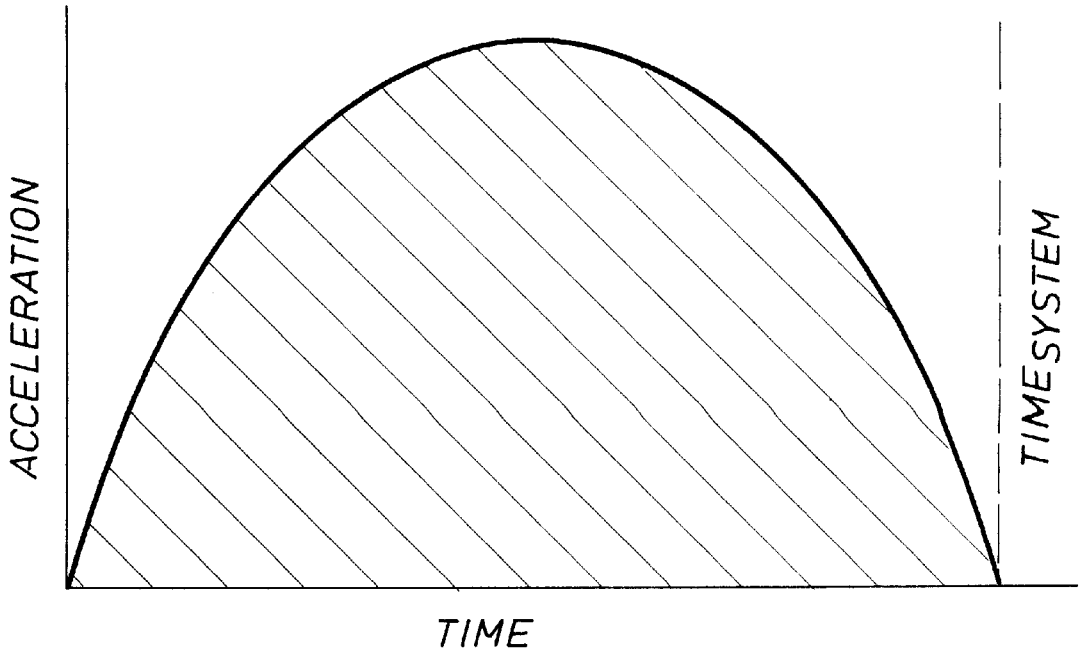
FIG. 14 is a graph of acceleration versus time of the present invention.

Reference is now made to FIGS. 13 and 14 which generally describe the physics associated with the improvement provided by the present invention. As described above, the present invention enhances the workout and provides for a more natural feeling since it essentially eliminates the need for the user to exert force to start each traveler from a zero velocity to the normal operating speed of the system. In prior art devices as the user finishes movement of each stroke, the user must then accelerate a pedal from a zero velocity to the velocity of his normal gait before experiencing the normal exercise of walking or running. In normal outdoor constant speed running, the user merely has to maintain his body velocity. Therefore, the advantage of the present invention is that it eliminates this additional exertion of energy associated with moving the forward traveler from a zero velocity to the velocity of the user and it eliminates the need for the user to accelerate the rearward traveler from a zero velocity forward to return the second traveler back to the active position for the next stroke. This is illustrated graphically in FIGS. 13 and 14.

Referring to FIG. 13, the velocity of a traveler is plotted versus time. At the beginning of each active stroke, the front traveler is at zero velocity as it begins to move rearwardly. At time, $t_{system}$, the velocity of the traveler has reached the system speed, $V_{system}$. FIG. 13 is a plot of velocity versus time for the present invention as well as the prior art. However, the present invention eliminates the need for the user to exert the energy needed to move each traveler from velocity $V_0$ to $V_{system}$ through the use of the inertia drive system. This is illustrated graphically in FIG. 14. FIG. 14 is a plot of acceleration versus time. The present invention in essence accelerates each traveler at the beginning of each stroke (that is, the front traveler moving rearwardly and the rear traveler moving forwardly) so that the user does not need to exert that additional energy. As shown in FIG. 14, the present invention serves to accelerate each traveler and then decreases the acceleration to zero at time, $t_{system}$. At this point, each traveler is moving at the speed that the user is exercising. Obviously, the user may exercise more vigorously changing the velocity of the system. But in any event, the present invention continues to provide the acceleration needed to enable each traveler to reach system velocity without the user expending additional energy to do such.

FIGS. 9, 10, 11, and 12 disclose an alternate embodiment of the present invention. Identical three-digit reference numerals will be used to designate similar structure found in the preferred embodiment but with a 1000 series prefix.

Figure 9:
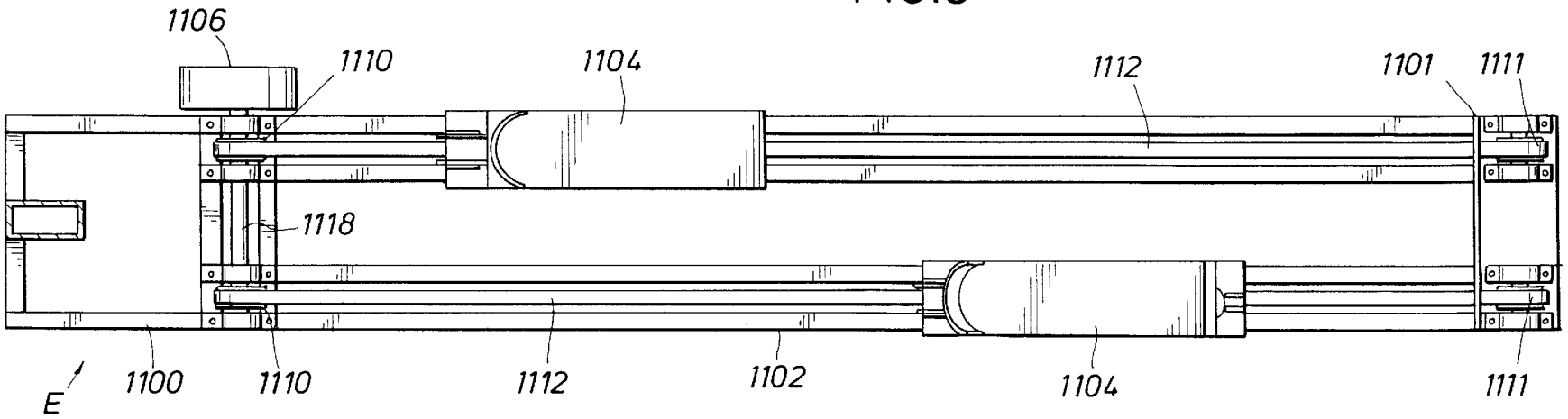
FIG. 9 is a plan view of an alternative embodiment of the present invention.
Figure 10:
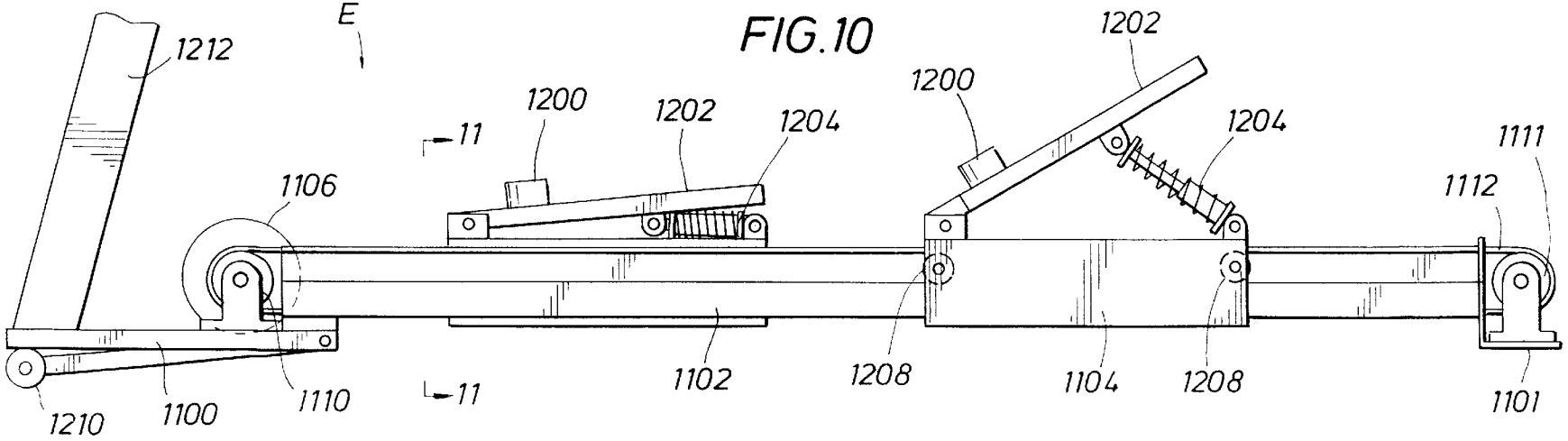
FIG. 10 is an elevation view of the alternative embodiment of the present invention.

Referring to FIGS. 9 and 10, stationary exercise apparatus E' includes a front frame 1100 and a rear frame 1101. Front frame 1100 and rear frame 1101 are connected by rails 1102 and are supported by the floor. An elevation adjustment arm 1210 is pivotally attached to front frame 1100 and a stand 1212 is also connected to front frame 1100. Stand 1212 may include handles or armrests, or may include any panels or gauges which may represent time spent or exercise amount completed. Elevation adjustment arm 1210 is maneuverable such that the front end of the stationary exercise apparatus E' is upwardly adjustable.

Rails 1102 are generally parallel to each other and are placed a distance apart at the approximate width of a human's stance.

As in the preferred embodiment, travelers 1104 include foot attachment carriages and wheels. Each foot attachment carriage includes a foot base portion 1202, a spring 1204 and a foot toe piece 1200. Each traveler 1104 may move longitudinally along flange 1209 of rail 1102 via wheels 1208.

Each foot attachment carriage is pivotally connected to a traveler 1104 at the front and top edge of the traveler 1104. As pressure is released off each foot base portion 1202, spring 1204 expands, forcing the rear end of the foot base portions 1202 to elevate.

Each traveler 1104 is movably engageable with an inertia belt 1112. Each inertia belt 1112 runs longitudinally with, and is substantially contained within, a rail 1102. Each inertia belt 1112 is attached to the front frame 1100 through drive pulleys 1111 and to rear frame 1101 through idle pulleys 1110. The inertia transfer portion of stationary exercise apparatus E' includes front pulleys 1111, an inertia shaft 1118, and a flywheel/brake 1106. Pulleys 1111 are fixedly connected to inertia shaft 1118 which is connected to flywheel/brake 1106. As discussed below, the movement of travelers 1104 forces each inertia belt 1112 to travel in the counterclockwise direction of arrow B'. This rotational path forces inertia shaft 1118 and the flywheel/brake 1106 to rotate in the same counterclockwise direction, B'.

Figure 11:
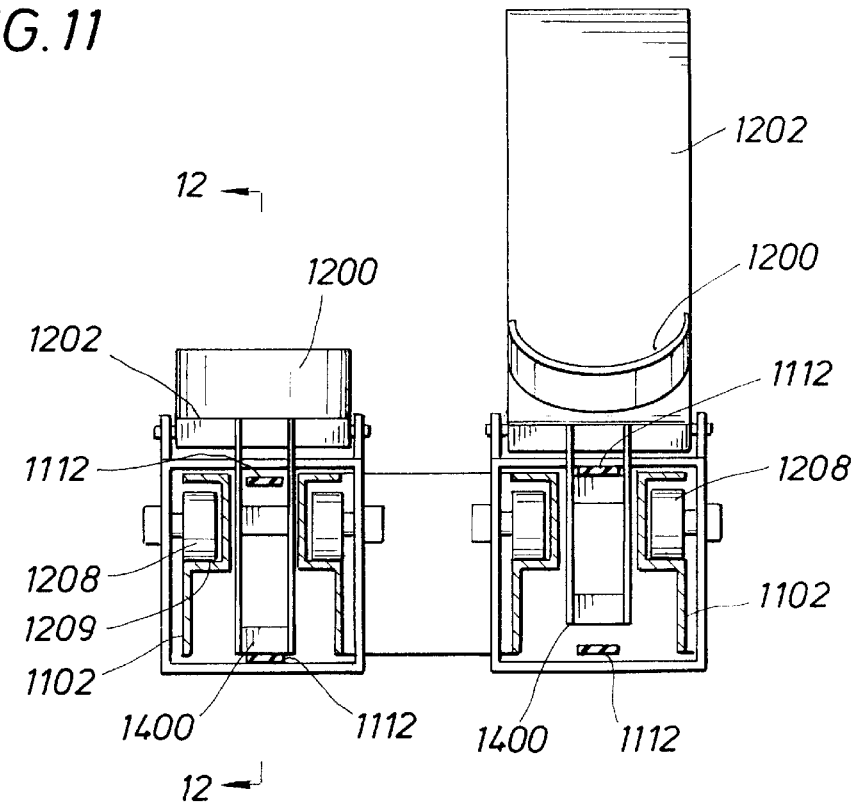
FIG. 11 is a cross-sectional view of the alternative embodiment of the present invention taken along line 11—11 of FIG. 10.
Figure 12:
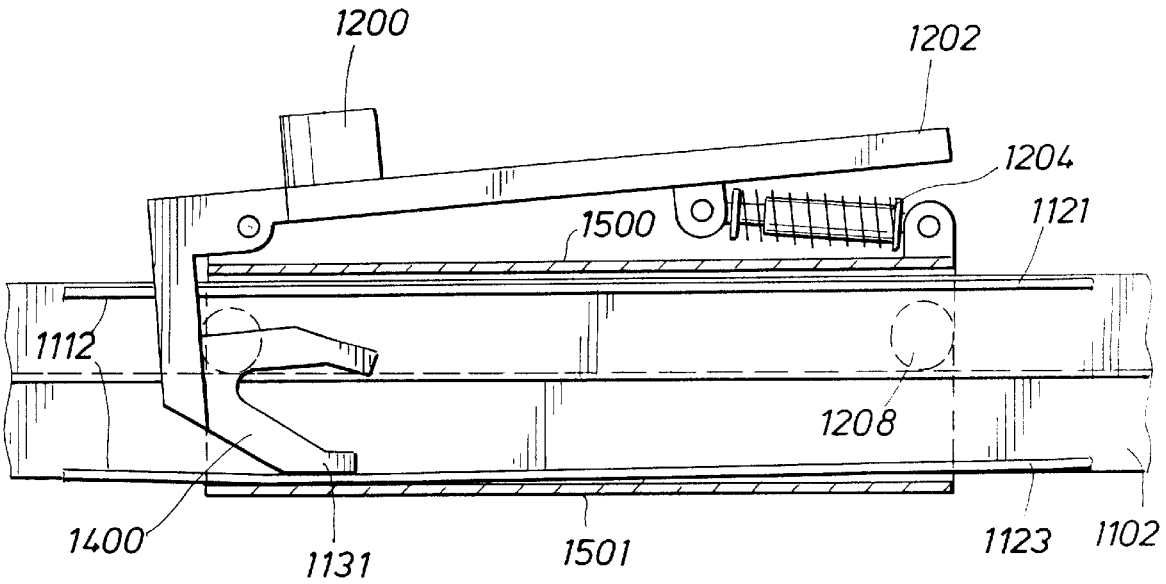
FIG. 12 is a cross-sectional view of the alternative embodiment taken along line 12—12 of FIG. 11.

Referring now to FIGS. 11 and 12, each traveler 1104 includes wheels 1208 which enable movement of each traveler 1104 along flange 1209 of rail 1102. As shown, each inertia belt 1112 includes two segments, an upper segment 1121 and a lower segment 1123.

As shown in FIG. 12, each traveler 1104 includes a foot attachment carriage having the foot base portion 1202. A lip 1131 of a coupling member 1400 is attached to the bottom edge of the foot base portion 1202, and serves to compress the lower portion 1123 of inertia belt 1112 against a base 1501 of traveler 1104. This occurs when the user's leg presses down on base portion 1202, compressing spring 1204 thereby coupling member 1400 to the lower portion 1123 of inertia belt 1112. This forces inertia belt 1112 toward the rear of the stationary exercise apparatus E' as the user moves the traveler 1104 to the rear. Thus, inertia belt 1112 moves in unison with the traveler 1104 as the traveler 1104 travels from the front end to the rear end when the foot attachment carriage is in the substantially horizontal position or the active position. It is this movement which puts energy into the inertia system.

When the foot attachment carriage is in the inclined position or inactive position, lip 1131 of coupling member 1400 forcibly engages upper portion 1121 of inertia belt 1112 against frame 1500 of traveler 1400. Thus, the traveler 1104 moves forward in unison with the inertia belt 1112 as the inertia belt 1112 travels from the rear end to the front end of apparatus E'. This is the inactive position. Thus, as the user lifts his foot, the foot base portion 1202 elevates due to spring 1204, enabling lip 1131 to engage the upper portion of the inertia belt 1112, and the forward motion of belt 1112 forces the traveler to move from the rear portion of the stationary exercise apparatus E' to the front portion of the stationary exercise apparatus without any energy being expended by the user.

Each traveler 1104 is moving in an opposite and reciprocal manner. When the foot attachment carriage is in the substantially horizontal or active position, inertia of belt 1112, inertia shaft 1118, and flywheel/brake 1106 are being rotated in a counterclockwise direction. When the foot attachment carriage is in the inclined or inactive position, the inertia of the flywheel accelerates the rear traveler 1104 forward.

The foregoing disclosure and description of the invention are illustrative and explanatory thereof and various changes to the size, shape, materials, components may be made without departing from the spirit of the invention.

What is claimed is:

1. A stationery exercising apparatus comprising:

a frame;

first and second longitudinal rails attached to at least a portion of the frame;

first and second travelers, said first traveler movably engageable to said first rail and said second traveler movably engageable to said second rail;

an inertia drive assembly proximate one end of said first and second rails; and means for engaging said first and second travelers with said inertia drive assembly, wherein as each said first and second traveler initially advances rearwardly or forwardly, said inertia drive assembly accelerates each said traveler up to a predetermined velocity without the user having to exert additional force to accelerate said travelers up to said predetermined velocity.

2. A stationary exercising apparatus comprising:

a frame;

first and second longitudinal rails attached to at least a portion of the frame, each rail having a first end and second end, said first rail being generally parallel with said second rail;

first and second travelers, said first traveler movably engageable to said first rail and said second traveler movably engageable to said second rail;

an inertia drive assembly proximate one end of said first and second rails;

a first belt spanning substantially the entire travel distance of the first traveler along said first rail;

a second belt spanning substantially the entire travel distance of the second traveler along said second rail; and a coupling assembly having:

a first coupling member having means for selectively engaging said first traveler to said first belt, and a second coupling member having means for selectively engaging said second traveler to said second belt, wherein during operation of the apparatus the inertia drive assembly initially accelerates each said traveler up to a predetermined velocity without the user having to exert additional force to accelerate said travelers up to said predetermined velocity.

3. The apparatus of claim 2, wherein each said first and second belts has an upper segment and a lower segment.

4. The apparatus of claim 3, wherein each said means for selectively engaging said first and second travelers to said first and second belts includes a clamping member for securing the lower segment of said first and second belts when said first and second travelers are moved toward the second end of said first and second rails and for securing the upper segment of said first and second belt when said first and second travelers are moved toward the first end of said first and second rails.

5. A stationary exercising apparatus comprising:

a frame;

first and second longitudinal rails attached to at least a portion of the frame, each rail having a first end and second end, said first rail being generally parallel with said second rail;

first and second travelers, said first traveler movably engageable to said first rail and said second traveler movably engageable to said second rail so that each traveler moves independently of the other traveler;

an inertia drive assembly coupled to the frame having a shaft supported by the frame proximate the first ends of said first and second rails;

a first pulley proximate the second end of said first rail and a second pulley proximate the second end of said second rail;

a first belt spanning substantially the entire travel distance of the first traveler between said inertia drive shaft and said first pulley;

a second belt spanning substantially the entire travel distance of the second traveler between said inertia drive shaft and said second pulley; and a coupling assembly having:

a first coupling member having means for selectively engaging said first traveler to said first belt, and a second coupling member having means for selectively engaging said second traveler to said second belt, wherein during operation of the apparatus the inertia drive assembly initially accelerates each said traveler up to a predetermined velocity without the user having to exert additional force to accelerate said travelers up to said predetermined velocity.

6. The apparatus of claim 5, wherein each said first and second belts has an upper segment and a lower segment.

7. The apparatus of claim 6, wherein each said means for selectively engaging said first and second travelers to said first and second belts includes a clamp member for securing the lower segment of said first and second belts when said first and second travelers are moved toward the second end of said first and second rails and for securing the upper segment of said first and second belts when said first and second travelers are moved toward the first end of said first and second rails.

8. A stationary exercise apparatus comprising:

a first frame;

first and second longitudinal rails attached to said first frame, each rail having a first end and second end, said first rail being generally parallel with said second rail;

a second frame attached to said second end of said first and second rails;

first and second travelers, said first traveler movably attached to said first rail and said second traveler movably attached to said second rail so that each traveler moves independently of the other traveler;

an inertia drive assembly coupled to said frame having a shaft supported by said frame proximate the first ends of said first and second rails;

a first pulley proximate the second end of said first rail;

a second pulley proximate the second end of said second rail;

a first belt spanning substantially the entire length of said first rail between said inertia drive shaft and said first pulley;

a second belt spanning substantially the entire length of said second rail between said inertia drive shaft and said second pulley; and a coupling assembly having:

a first coupling member having means for selectively engaging said first traveler to said first belt, and a second coupling member having means for selectively engaging said second traveler to said second belt, wherein during operation of the apparatus the inertia drive assembly initially accelerates each of said travelers up to a predetermined velocity without the user having to exert additional force to accelerate said travelers up to said predetermined velocity.

9. The apparatus of claim 8, wherein each said first and second belts has an upper segment and a lower segment.

10. The apparatus of claim 9, wherein each said means for selectively engaging said first and second travelers to said first and second belts includes a clamp member for securing the lower segment of said first and second belts when said first and second travelers are moved toward the second end of said first and second rails and for securing the upper segment of said first and second belts when said first and second travelers are moved toward the first end of said first and second rails.

11. A stationary exercise apparatus comprising:

a first frame;

first and second longitudinal rails attached to said first frame, each rail having a first end and second end, said first rail being generally parallel with said second rail;

a second frame attached to said second end of said first and second longitudinal rails, said first frame, second frame, and first and second longitudinal rails adapted to be supported by the floor;

first and second travelers, said first traveler movably attached to said first rail and said second traveler movably attached to said second rail so that each traveler moves independently of the other traveler;

an inertia drive assembly having:

a shaft supported by said first frame proximate the first ends of said first and second rails; and a flywheel attached to said shaft;

a first pulley supported by said second frame proximate the second end of said first rail and a second pulley supported by said second frame proximate the second end of said second rail;

a first belt spanning substantially the entire travel distance of the first traveler;

a second belt spanning substantially the entire travel distance of the second traveler;

a first coupling member pivotally connected to said first traveler; and a second coupling member pivotally connected to said second traveler, wherein during operation of the apparatus the inertia drive assembly initially accelerates each of said travelers up to a predetermined velocity without the user having to exert additional force to accelerate said travelers up to said predetermined velocity.

12. The apparatus of claim 11, wherein each said first and second belts has an upper segment and a lower segment.

13. The apparatus of claim 11, wherein said first and second coupling members engage the lower segments of said first and second belts when said first and second travelers are moved toward the second end of said first and second rails and said coupling members engage the upper segments of said first and second belts when second travelers are moved toward the first end of said first and second rails.

14. The apparatus of claim 11, wherein each said first and second travelers further comprises a base and a foot attachment carriage, each said foot attachment carriage having a first end and a second end, and pivotally coupled to said base at the first end of said foot attachment carriage.

15. The apparatus of claim 14, wherein each said first and second travelers further comprises a spring coupled to said foot attachment carriage and said base for pivoting said foot attachment carriage.

16. The apparatus of claim 11, wherein each said first and second belts has an upper segment and a lower segment.

17. The apparatus of claim 16, wherein each said first and second coupling members include a clamp member for securing the lower segment of said first and second belts when said first and second travelers are moved toward the second end of said first and second rails and for securing the upper segment of said first and second belts when said first and second travelers are moved toward the first end of said first and second rails.

* * * * *